US009757739B2

(12) United States Patent
Sato et al.

(10) Patent No.: US 9,757,739 B2
(45) Date of Patent: Sep. 12, 2017

(54) CENTRIFUGE WITH SAMPLE BUCKET HAVING GROOVES AND SWING ROTOR FOR THE SAME

(71) Applicant: Hitachi Koki Co., Ltd., Tokyo (JP)

(72) Inventors: Jun Sato, Ibaraki (JP); Kenichi Nemoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 14/994,153

(22) Filed: Jan. 13, 2016

(65) Prior Publication Data

US 2016/0214118 A1 Jul. 28, 2016

(30) Foreign Application Priority Data

Jan. 28, 2015 (JP) ..... 2015-014392

(51) Int. Cl.
*B04B 5/04* (2006.01)

(52) U.S. Cl.
CPC .... *B04B 5/0421* (2013.01); *B04B 2005/0435* (2013.01)

(58) Field of Classification Search
CPC ..... B04B 5/0421; B04B 2005/0435
USPC ..... 494/16–21, 12, 31, 33, 43, 81; 422/548; 220/669, 671
See application file for complete search history.

(56) References Cited

U.S. PATENT DOCUMENTS 3,873,021 A * 3/1975 Paulsen ..... B04B 5/0421 494/20
7,837,036 B2 * 11/2010 Davis ..... B65D 1/26 206/505
8,245,847 B2 * 8/2012 Davis ..... B65D 1/26 206/512
2011/0183829 A1 * 7/2011 Nemoto ..... B04B 5/0421 494/20
2016/0158744 A1 * 6/2016 Piramoon ..... B01L 3/508 422/548
2016/0214118 A1 * 7/2016 Sato ..... B04B 5/0421
2017/0050196 A1 * 2/2017 Sato ..... B04B 5/02

FOREIGN PATENT DOCUMENTS

JP 2011-147908 8/2011

* cited by examiner

*Primary Examiner* — Charles Cooley
(74) *Attorney, Agent, or Firm* — Jianq Chyun IP Office

(57) ABSTRACT

A centrifuge and a rotor thereof are provided. The centrifuge performs centrifugation in a state where the sample container is swung by rotation and seated in a cutout part of a rotor body. The sample container includes a bucket accommodating a container filled with a sample, and a lid for sealing the bucket and having a rotation shaft. Grooves extending in the longitudinal direction are formed on the outer peripheral surface of the bucket on the bottom side with respect to a seating surface of the bucket. The grooves are arranged at equal intervals in the circumferential direction. Formation of the grooves can prevent increasing the weight of the bucket and realize a highly rigid sample container that can withstand deformation.

13 Claims, 10 Drawing Sheets

CENTRIFUGE WITH SAMPLE BUCKET HAVING GROOVES AND SWING ROTOR FOR THE SAME

CROSS-REFERENCE TO RELATED APPLICATION

This application claims the priority benefit of Japan application serial no. 2015-014392, filed on Jan. 28, 2015. The entirety of the above-mentioned patent application is hereby incorporated by reference herein and made a part of this specification.

BACKGROUND OF THE INVENTION

Field of the Invention

The invention relates to a centrifuge for separating a sample in the fields of medicine, pharmacy, genetic engineering, biotechnology, and so on, and particularly relates to securing strength and enhancing operability through improvement of the rigidity of a sample container for the centrifuge with a swing type rotor.

Description of Related Art

A centrifuge is a device, which includes a rotor capable of accommodating a plurality of sample containers filled with samples therein and a driving means, such as a motor, rotationally driving the rotor in a rotor chamber, and rotates the rotor at a high speed to apply a centrifugal force, so as to centrifugally separate the samples in the sample containers. Centrifuge rotors can be roughly divided into two types, i.e. angle rotor and swing rotor. In the case of the angle rotor, a plurality of tubes filled with the sample therein are accommodated in accommodation holes, and a lid is fastened to the rotor to prevent the inside of the rotor from being decompressed when windage loss reduction occurs above the opening parts of the accommodation holes and the rotor chamber is decompressed by a vacuum pump. The accommodation holes are formed at a certain fixed angle with respect to the driving shaft, and the relative angle between the accommodation holes and the driving shaft is fixed at all times regardless of the centrifugal force.

In contrast, the swing rotor has a sample container including a bucket with a bottom part, which accommodates tubes filled with the sample, a lid, which covers the inside of the bucket, and a sealing member such as an O-ring, which seals a bonding surface between the bucket and the lid, and has a rod-shaped or convex rotation shaft disposed on the bucket or the lid and engaged with rotation shaft engaging grooves formed on the rotor, so as to dispose the sample container in the rotor in a swingable manner to perform centrifugal separation. The central axis of the sample container and the driving shaft of the motor are parallel to each other ($\theta=0°$) when the rotor is stationary. However, as the rotation speed increases, the sample container disposed in the swingable manner is affected by the centrifugal force to rotate around the rotation axis so that $\theta>0°$ , and then becomes substantially horizontal ($\theta\approx90°$) when a rotation speed that generates a centrifugal force sufficient to make the sample container horizontal is reached. Thereafter, the centrifugation ends, and $\theta$ decreases as the rotation speed drops and becomes 0° ($\theta=0°$) when the rotation of the rotor stops. Thus, the relative angle between the central axis of the sample container and the driving shaft of the swing rotor changes according to the centrifugal force during the centrifugation. In addition, there are mainly two types of forms for holding the centrifugal load of the sample container during the centrifugation of the swing rotor. One form is that the convex parts of the rotation shaft disposed on the rotor or the bucket or the lid of the sample container are received by the opposing concave parts and the load caused by the centrifugal force of the sample container is held only by the convex parts or the concave parts. The other form is that the sample container is swung to the horizontal by the rotation shaft disposed on the rotor or the bucket or the lid of the sample container, and from there, the rotation shaft is slid in the axial direction to seat the sample container on a wall surface of the rotor, such that the load caused by the centrifugal force of the sample container is held by the rotor body (see Patent Literature 1, for example).

PRIOR ART LITERATURE

Patent Literature

Patent Literature 1: Japanese Patent Publication No. 2011-147908

SUMMARY OF THE INVENTION

Problem to be Solved

For the form that swings the sample container to the horizontal by the rotation shaft disposed on the rotor or the bucket or the lid of the sample container and from there bends the rotation shaft to seat the sample container on the rotor, so as to hold the load caused by the centrifugal force of the sample container with the rotor body, as disclosed in Patent Literature 1, in the sample container holding part of the rotor body, one cannot dispose a seating surface of the sample container in a range that interferes with the swing path of the sample container. The surface pressure applied on the seating surface by the centrifugal load of the sample container is kept as low as possible to favor the strength of the rotor body. Thus, it is preferable to secure as much seating surface as possible. For this reason, the seating surface of the sample container to be disposed on the rotor body is often formed into an inverted U shape by removing the portion that interferes with the path of the sample container. Since the seating surface has the inverted U shape, the seating surface of the sample container has a portion that is held by the inverted U-shaped range and a portion that is not held. The support state is not uniform, and a bending force is applied on the sample container in the longitudinal direction of the sample container with the front end of the inverted U-shaped opening as the fulcrum. The traditional method is to increase the bucket thickness to enhance the rigidity against the bending force. However, because the thickness increases, this method has the disadvantage of increasing the weight of the bucket. The increase of the load applied on the rotor body and the sample container itself has the problem that the sample container or the rotor body needs to be designed to be firm with use of a strong material so as to withstand the applied load, and consequently the overall product price rises.

Moreover, the cylindrical portions of the buckets of the traditional sample containers are smooth and hardly formed with an uneven outer peripheral surface. Thus, the cylindrical portion held by the operator with one hand may easily slip when the operator opens or closes the lid. If slip occurs during opening and closing of the lid, the vibration generated when the lid is opened may be transmitted to the sample to disturb the separation layers of the sample that has been separated.

In view of the aforementioned background, the invention provides a centrifuge and a swing rotor for the centrifuge, which improve the bending rigidity while reducing the weight of the sample container to minimize the deformation during centrifugal rotation, so as to achieve stress reduction. The invention further provides a centrifuge and a swing rotor for the centrifuge, which make it easy to open and close the lid, so as to avoid disturbing the sample when the lid is opened or closed.

Solution to the Problem

According to the invention, a centrifuge includes: a driving part having a driving shaft; a rotor body disposed on a front end of the driving shaft; and a sample container including a rotation shaft for swing. The rotor body includes a through hole, a pair of support parts rotatably supporting two ends of the rotation shaft of the sample container installed in the through hole, and a cutout part formed on a radial outer side in a vertical direction with respect to a central axis of the through hole. The centrifuge swings the sample container in a state where the rotation shaft is supported by the support parts by rotation of the rotor body and performs a centrifugation in a state where the sample container is seated on a bucket receiving surface of the rotor body. The sample container includes a bucket accommodating a container to be filled with a sample, and a lid for sealing the bucket and having the rotation shaft. The bucket includes a curved seating surface to be seated on the rotor body during a centrifugal rotation, and a plurality of grooves extending in a longitudinal direction on an outer peripheral surface on a bottom side with respect to the seating surface of the bucket. By forming the grooves, deformation of the sample container due to the centrifugal load caused by rotation of the rotor can be suppressed and the stress can be reduced. An opening surface of the grooves includes a tapered termination part near the seating surface and a tapered termination part near a bottom.

According to the invention, a cross-sectional shape of the grooves perpendicular to the longitudinal direction of the grooves has a curved surface or a V shape. The bucket includes an opening part, the seating surface formed on a lower side with respect to the opening part, a parallel surface having a substantially constant outer diameter, and the bottom closing a front end of the parallel surface. The seating surface and an outer surface of the parallel surface are connected by a tapered surface having an outer diameter that gradually decreases from the seating surface to the parallel surface. The grooves are formed to extend from a part of the tapered surface throughout the outer surface of the parallel surface. The grooves may be formed to be continuous for ½ or more of a length of the tapered surface and ½ or more of a length of the parallel surface respectively from a boundary portion between the tapered surface and the parallel surface.

According to the invention, a width of the grooves in a side view of the bucket is wide in a part near the seating surface and narrow in a part near the bottom. The bucket is integrally formed with a titanium alloy or aluminum alloy. Four or more grooves are formed at equal intervals in a circumferential direction of the bucket without interfering with one another.

Effects of the Invention

According to the invention, partial deformation of the sample container due to non-uniform support of the bucket seating surface can be suppressed and consequently the stress applied on the sample container can be reduced. Therefore, the lifespan and replacement period can be extended to achieve cost reduction. Furthermore, because the groove or rib provides an anti-slip effect, the effect of facilitating the opening and closing of the lid is achieved.

The aforementioned and other novel features of the invention can be understood through the description of the specification and the figures below.

BRIEF DESCRIPTION OF THE DRAWINGS

FIG. 10(2) is a cross-sectional view of the broken line 10(2)-10(2) of FIG. 9.

DESCRIPTION OF THE EMBODIMENTS

Embodiment 1

Figure 1:
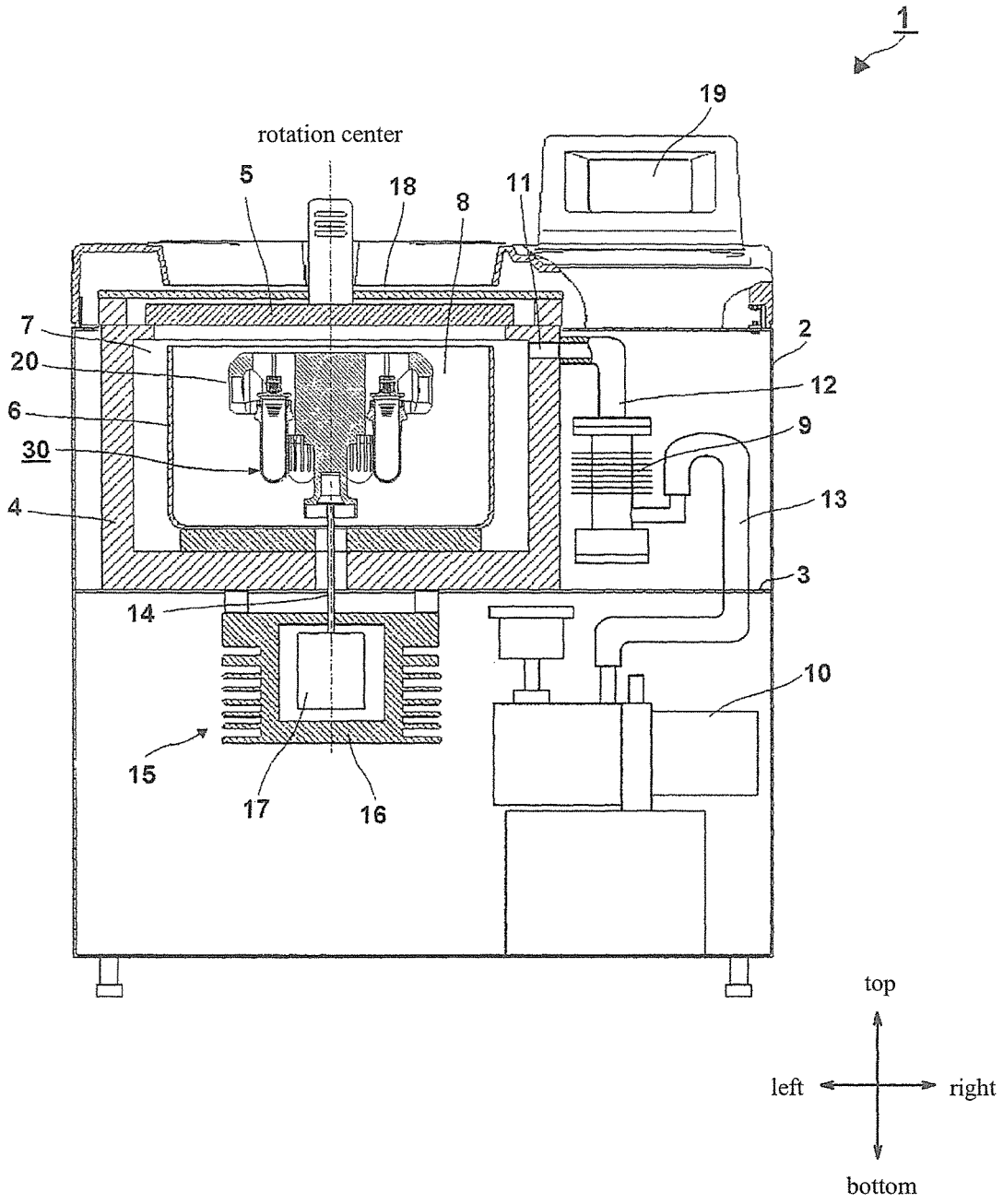
FIG. 1 is a longitudinal cross-sectional view showing the overall configuration of the first embodiment of the centrifuge according to the invention.

Hereinafter, embodiments of the invention are described with reference to the figures. In the figures below, the same parts are assigned with the same reference numerals, and repeated descriptions will be omitted. Moreover, in this specification, the vertical and horizontal directions, axial direction, and longitudinal direction refer to the directions shown in the figures.

A centrifuge 1 is accommodated in a box-shaped case 2 that is made of sheet metal or plastic, and the interior of the case 2 is partitioned into an upper space and a lower space by a horizontal partition plate 3. A protective wall 4 is disposed inside the upper space. The protective wall 4 and a door 5 define a decompression chamber 7 where a bowl 6 is accommodated. Then, by closing the door 5, the decompression chamber 7 is sealed by a door packing (not shown). The bowl 6 has a cylindrical shape that is open on the top side and substantially closed on the bottom side. A rotor body 20, on which a plurality of sample containers 30 are disposed in a swingable manner, is accommodated in an interior space (rotor chamber 8) of the bowl 6.

The rotor body 20 is rotatable around a driving shaft 14 serving as the rotation axis, and holds and rotates the plurality of sample containers 30 at a high speed. The driving shaft 14 is rotated by a motor 17 that is accommodated in a driving part 15, and the rotation of the motor 17 is controlled by a control device (not shown). As the rotor body 20 rotates, the sample containers 30 are swung (rotated) by the centrifugal force in the direction the centrifugal force is applied (radially outward when viewed from the rotation axis) to move the central axis of the sample containers 30 from the vertical direction to the horizontal direction. The rotor body 20 rotates at a high speed while holding the sample that is to be separated. FIG. 1 illustrates a state where the rotor body 20 is stopped and the central axis of the sample container 30 is in the vertical direction. A centrifuge that uses the rotor body 20 and so on of this embodiment is the so-called ultracentrifuge that can rotate at a maximum rotation speed of 100,000 rpm or more, for example. In the lower space partitioned by the partition plate 3 in the case 2, the driving part 15 is attached to the partition plate 3 and the motor 17 serving as the driving source is accommodated in a housing 16 of the driving part 15. The driving shaft 14 extends vertically above the motor 17 and passes through the bowl 6 to enter the rotor chamber 8. The rotor body 20 is detachably installed on the upper end of the driving shaft 14.

The decompression chamber 7 is configured to be sealed by the door 5. In a state where the door 5 is opened, the rotor body 20 can be installed in or removed from the rotor chamber 8 in the bowl 6 through an upper opening 18. An oil diffusion vacuum pump 9 and an oil rotation vacuum pump 10 are connected in series to serve as a vacuum pump for discharging the atmosphere in the decompression chamber 7 to create a vacuum (decompression). That is, a vacuum drawing opening 11 formed on the protective wall 4 that defines the decompression chamber 7 and a suction port of the oil diffusion vacuum pump 9 are connected by a vacuum pipe 12, and a discharge port of the oil diffusion vacuum pump 9 and a suction port of the oil rotation vacuum pump 10 are connected by a vacuum pipe 13. Because the oil diffusion vacuum pump 9 cannot draw a vacuum from the atmospheric pressure during decompression of the decompression chamber 7, vacuum drawing is carried out by the oil rotation vacuum pump 10 first. Then, when the oil diffusion vacuum pump 9 operates, the decompression chamber 7 is decompressed by the oil diffusion vacuum pump 9 and the oil rotation vacuum pump 10. Moreover, the oil diffusion vacuum pump 9 includes a boiler for storing oil, a heater for heating the boiler, a jet for injecting the oil molecules vaporized by the boiler in a certain direction, and a cooling part for cooling the vaporized oil molecules to liquefy the vaporized oil molecules.

A cooling device (not shown) for keeping the interior of the rotor chamber 8 at a desired low temperature is connected to the bowl 6. During the centrifugal rotation, the interior of the rotor chamber 8 is maintained a set environment under control of a control device. An operation display part 19 for the user to input conditions, such as the rotation speed and centrifugation time of the rotor, and for displaying various kinds of information is disposed on a side (right side) of the door 5. The operation display part 19 is for example a combination of a liquid crystal display device and operation buttons, or a touch liquid crystal panel.

Figure 2:
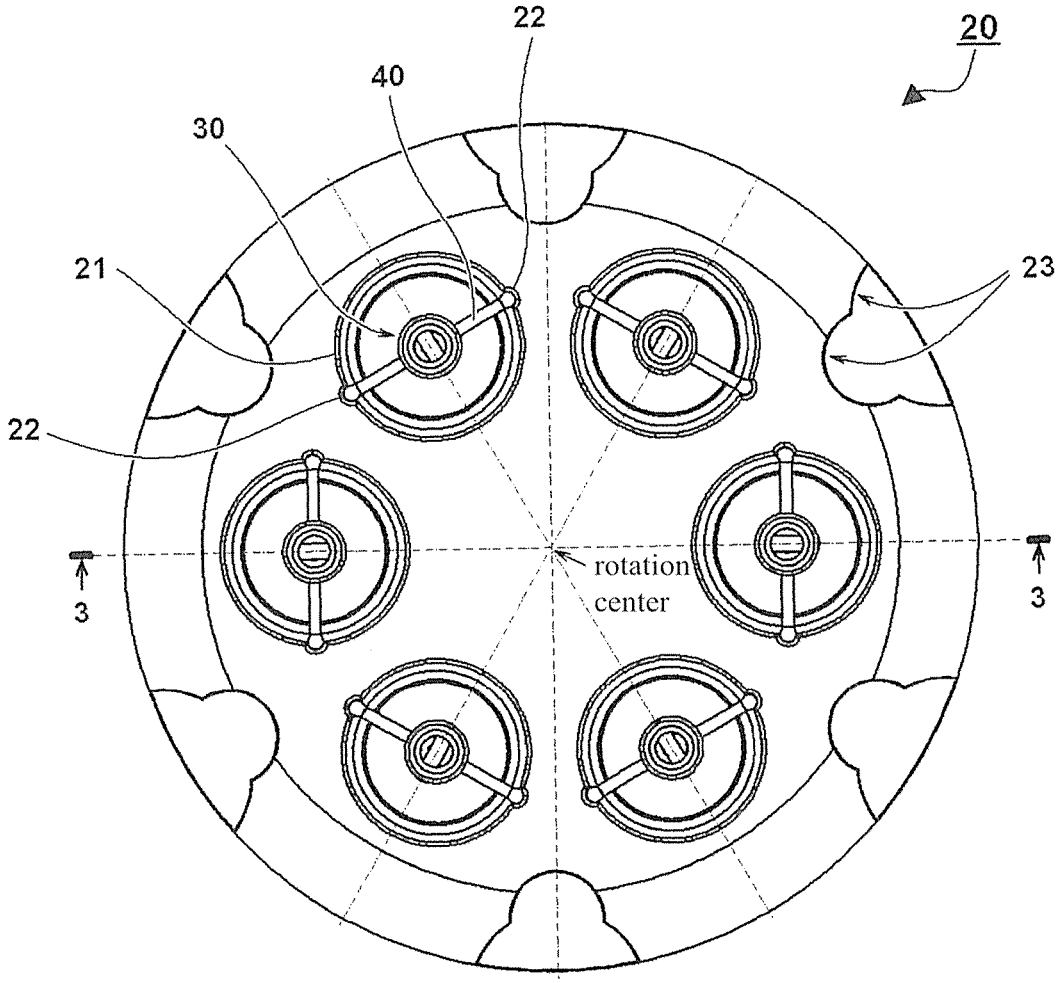
FIG. 2 is a top view of the rotor body 20 of FIG. 1.

FIG. 2 is a top view of the rotor body 20 and illustrates a state where the plurality of sample containers 30 are inserted into through holes 21 respectively. The rotor body 20 has a substantially circular outer shape when viewed from above and has a body with a diameter of about 100 mm to 300 mm, in which six through holes 21 having a diameter of about 20 mm to less than 50 mm are formed. The sample containers 30 are installed downward from above into the through holes 21 respectively. The sample container 30 is provided with a rotation shaft 40 that extends in a direction perpendicular to the central axis of the sample container 30. The sample container 30 is accommodated in the through hole 21 in a way that the longitudinal direction of the rotation shaft 40 is oriented in the circumferential direction. The six through holes 21, each being a cylindrical hole penetrating from the upper side to the lower side, are disposed at equal intervals with the center positions of the through holes being respectively separated 60 degrees in the circumferential direction. The diameter of the hole is slightly larger than the outer diameter of the sample container 30. Two rotation shaft engaging grooves 22, which are separated about 180 degrees in the circumferential direction of the inner wall of each through hole 21, are formed. The rotation shaft engaging grooves 22 extend downward in the axial direction from the upper opening of the through hole 21 to the middle of the through hole 21 without reaching the lower opening. The rotation shaft engaging grooves 22 serve as support parts for supporting two ends of the rotation shaft 40 of the sample container 30. The length of the rotation shaft 40 is slightly larger than the diameter of the through hole 21. Accordingly, if the positions of two ends of the rotation shaft 40 do not match the positions of the rotation shaft engaging grooves 22, the two ends of the rotation shaft 40 will be in contact with the upper end of the through hole 21 and cause that the sample container 30 cannot be inserted to a predetermined position in the through hole 21.

If the sample container 30 is inserted downward from the upper side of the through hole 21 with the two ends of the rotation shaft 40 being disposed along the rotation shaft engaging grooves 22, two sides of the rotation shaft 40 are held by the lower ends of the rotation shaft engaging grooves 22, such that the sample container 30 is held and does not fall down. Because the swing direction of the sample container 30 is in a plane perpendicular to the rotation shaft 40, an angle formed by the rotation shaft 40 and the plane is about 90 degrees. In addition, since it is necessary to make the plane including the swing direction coincide with the direction of the centrifugal load, the plane passes through the rotation axis (rotation center) of the driving shaft 14 (FIG. 1). Moreover, the outer edge shape of the rotor body 20, as viewed from above, may be substantially circular. In this embodiment, however, in order to reduce the mass, a cutout part for accommodating the bucket is formed perpendicular to the central axis of the through hole 21 on the radial outer side (see the bucket accommodating part 24 of FIG. 3). Furthermore, a recess portion for reducing the thickness is formed at where the through hole 21 of the rotor body 20 is not formed, i.e. the portion indicated by the arrow 23.

Figure 3:
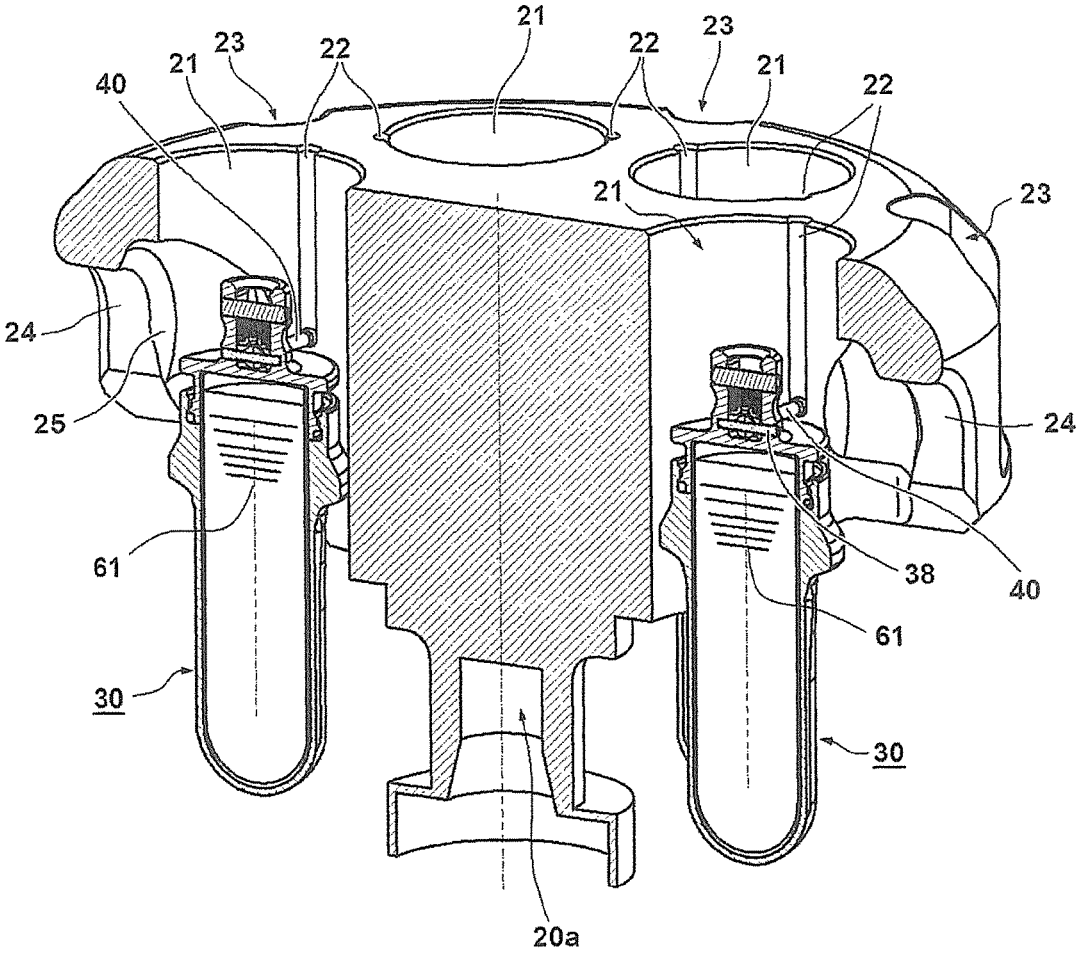
FIG. 3 is a perspective cross-sectional view of the broken line 3-3 of FIG. 2.

FIG. 3 is a cross-sectional view along broken line 3-3 of FIG. 2 and illustrates a state where the rotor body 20 is stopped and the longitudinal direction of the sample container 30 is in the vertical direction. A mounting part 20*a* is formed on the rotor body 20 on the lower side in the direction of the rotation axis to be set on a crown that is disposed on the front end of the driving shaft 14 (see FIG. 1). Since two ends of the rotation shaft 40 are in contact with the lower ends of the rotation shaft engaging grooves 22, the sample container 30 is kept at the position, as shown in the figure, and does not fall off from the rotor body 20. At the moment, the sample container 30 is not in contact with the rotor body 20, except for two end portions of the rotation shaft 40. When the motor 17 (see FIG. 1) is started to rotate the rotor body 20 from this state, the sample container 30 is swung (rotated) radially outward by the centrifugal force with the longitudinal direction of the rotation shaft 40 as the rotation axis. The swing of the sample container 30 continues until the longitudinal direction of the sample container 30 becomes horizontal (level). The bucket accommodating part 24, i.e. a semi-cylindrical part formed by cutting out a portion of the lower end of the rotor body 20 on the outer peripheral side, is formed such that the swing of the sample container 30 is not hindered by the rotor body 20. The bucket accommodating part 24 is a space that is formed by removing specific portions to prevent contact between the sample container 30 and the rotor body 20 during the swing of the sample container 30.

Figure 4:
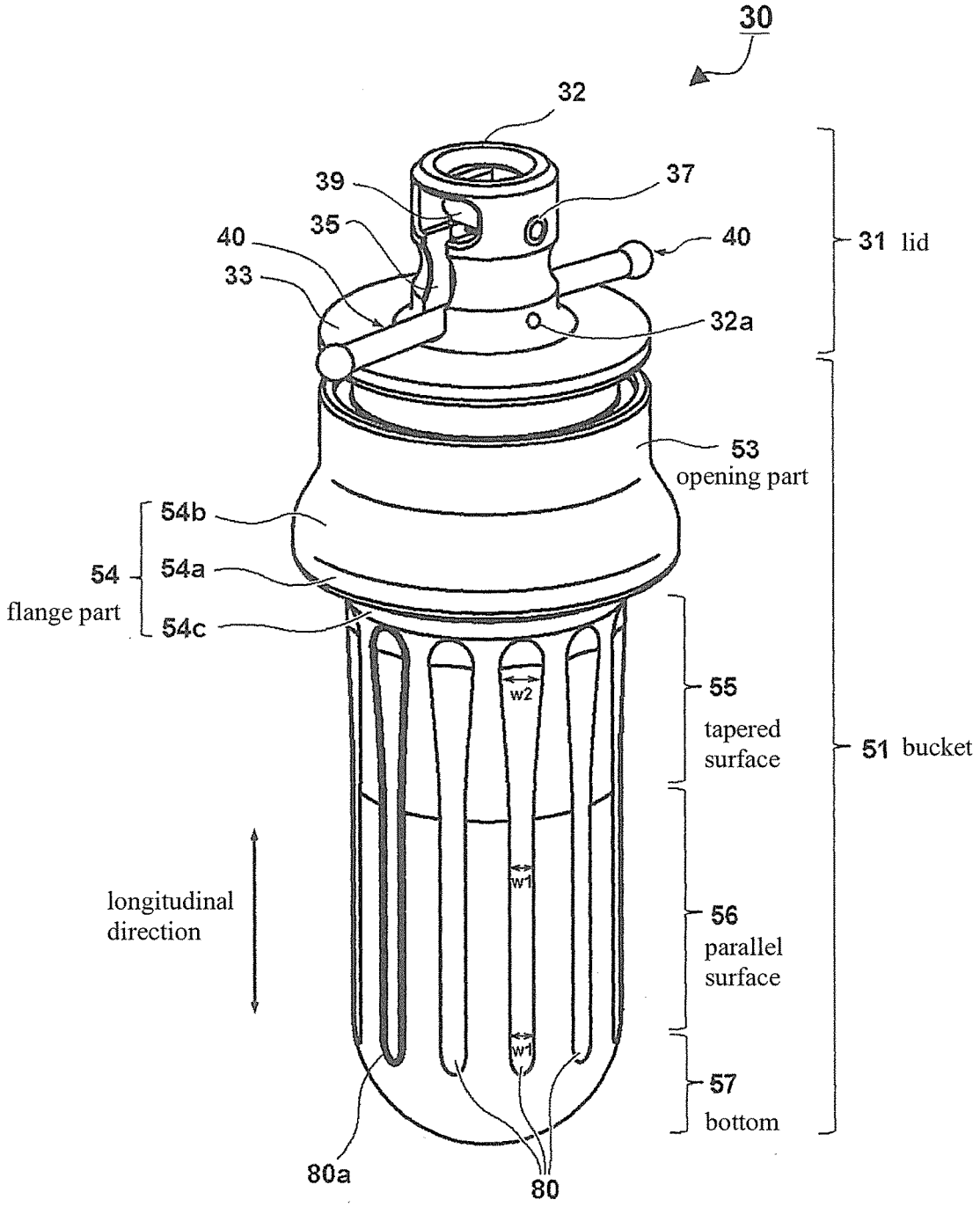
FIG. 4 is a perspective view showing the external configuration of the sample container 30 of FIG. 1.

FIG. 4 is a perspective view showing the external configuration of the sample container 30, wherein the sample container 30 is formed by installing a lid 31 to a bucket 51 that serves as the container portion. The bucket 51 is manufactured integrally by shaving a metal, e.g. a titanium alloy or an aluminum alloy having a high specific strength. A flange part 54 that extends in the radial direction is formed under an opening part 53 of the bucket 51. The flange part 54 includes a tapered surface 54*b* and a seating surface 54*c*. The tapered surface 54*b* is smoothly connected to an outer edge part 54*a* from the opening part 53. The seating surface 54*c* is an inclined surface that is formed on the lower side of the outer edge part 54*a* and is continuous in the circumferential direction to be in contact with a sidewall surface (bucket receiving surface 25) of the bucket accommodating part 24 of the rotor body 20. The tapered surface 54*b* has a diameter that gradually decreases from the flange part 54 to the opening part 53 above. The shape of the tapered surface 54*b* can be designed more freely. The seating surface 54*c*, however, is the portion that receives the centrifugal load of the sample container 30. Therefore, it is important to properly design the shapes of the flange part 54 (the seating surface 54*c*) and the bucket receiving surface 25 of the rotor body 20 (see FIG. 3) considering the strength. Moreover, by appropriately setting the shape of the seating surface 54*c*, even if the swing state of the sample container 30 is not ideal and the sample container 30 is swung in a slightly obliquely twisted state and causes a side of the body part of the sample container 30 to hit the bucket receiving surface 25 first, the sample container 30 will be guided by the centrifugal load to place the seating surface 54*c* in a position for favorable surface contact with the bucket receiving surface 25. A parallel surface 56 having uniform outer and inner diameters is formed under the seating surface 54*c*. The seating surface 54*c* and the parallel surface 56 are connected by a tapered surface 55 having an outer diameter that decreases gradually toward the bottom. A bottom 57 is formed on the lower side of the parallel surface 56. The bottom 57 is closed in a hemispherical shape on the outer and inner sides.

On the outer peripheral part of the bucket 51, a plurality of grooves 80 that extend in the axial direction are formed at equal intervals in the circumferential direction. The groove 80 is recessed in a concave shape from the outside to the inside in the radial direction. The groove 80 extends in the longitudinal direction from a portion of the tapered surface 55 near the seating surface 54*c* throughout the outer surface of the parallel surface 56 in the axial direction. The contour of an opening surface 80*a* of the groove 80 has a shape as surrounded by the bold line. Regarding the shape of the groove 80, the groove 80 has a characteristic shape due to a cutting direction as described later in FIG. 9. A maximum width of the groove 80 near the upper end of the tapered surface 55, as viewed in the circumferential direction, is w2. The groove 80 further has a width w1 in the parallel surface 56. The widths satisfy the relationship of w2>w1.

The lid 31 functions as a closure member for closing the opening of the opening part 53 to seal the interior space. Here, the lid 31 is installed to the opening part 53 of the bucket 51 by thread coupling. Nevertheless, the lid 31 may also be configured to be installed by an insertion system. A disc part 33 having a disc shape to serve as the lid body of the bucket 51 is formed near the vertical center of the lid 31. A cylindrical part 32 extending upward is formed on the central portion of the upper surface of the disc part 33. The cylindrical part 32 is opened on top, and the lower end thereof is connected to the disc part 33 to form a closed state. A through hole 35 is formed to penetrate the cylindrical surface of the cylindrical part 32 in the horizontal direction. The through hole 35 is not simply a long hole that extends in the direction the centrifugal load is applied, but has a substantially T shape in the side view with a long hole extending in the circumferential direction near the upper end. The rotation shaft 40 is disposed through the through hole 35. Two ends of the rotation shaft 40 protrude outward in the radial direction of the cylindrical part 32 from the through hole 35. The lid 31 is manufactured for example by shaving a metal, such as an aluminum alloy.

Figure 5:
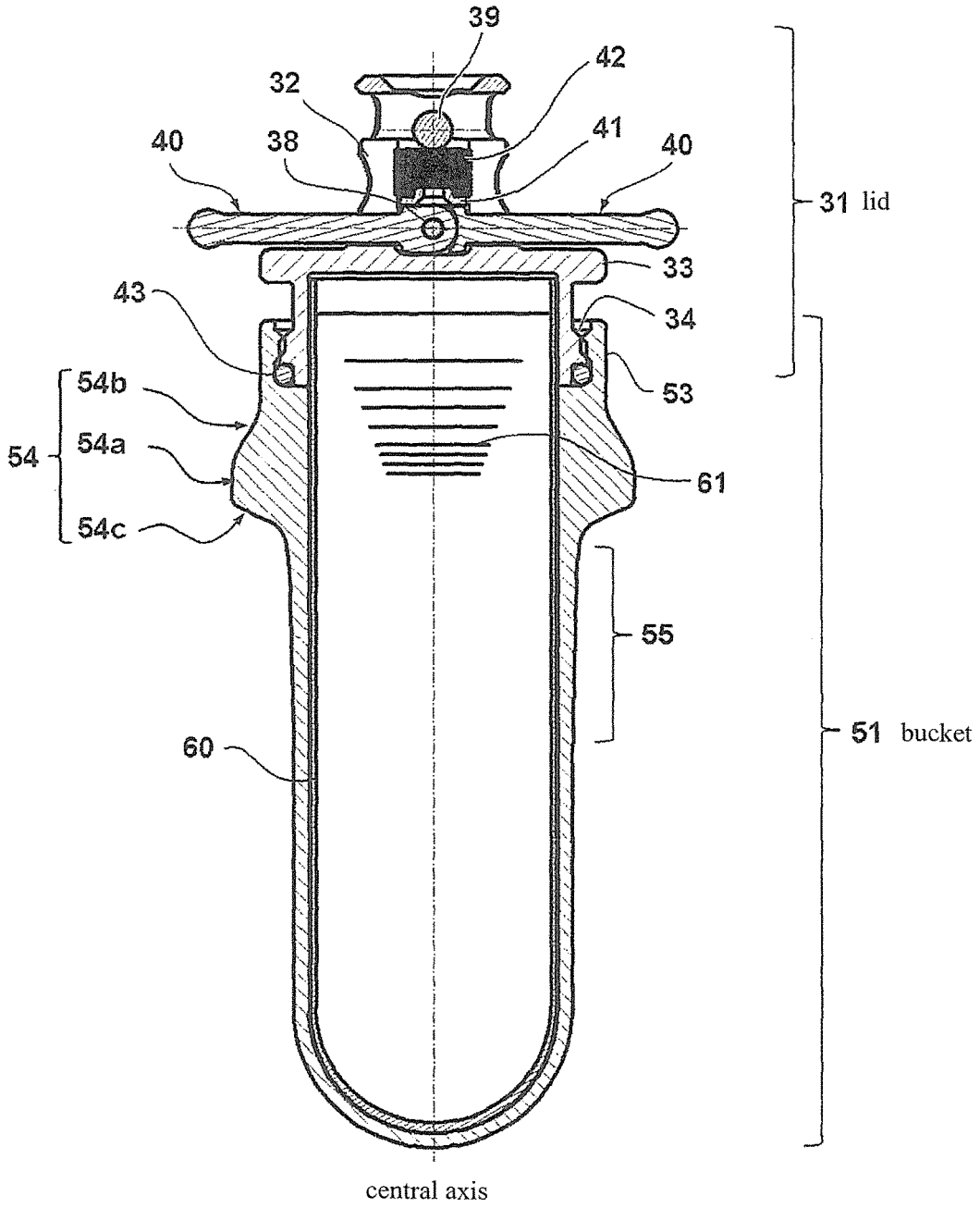
FIG. 5 is a longitudinal cross-sectional view of the sample container 30 of FIG. 1.

FIG. 5 is a longitudinal cross-sectional view of the sample container 30. A space conforming to the outer shape of a tube 60 is formed in the bucket 51. The opening part 53 for forming an opening for loading and unloading the tube 60 is formed in the upper portion of the bucket 51. The tube 60 is a substantially cylindrical container made of a synthetic resin, for example. The length of the tube 60 in the axial direction is about 100 mm and the diameter of the opening part is about 25 mm. A sample 61, which is the target for centrifugal separation, is put in the tube 60. The tube 60 may have various shapes and sizes pursuant to the application or the centrifugal acceleration required. Here, with the exception of the hemispherical bottom portion, the tube 60 has constant inner and outer diameters. Corresponding thereto, the inner diameter of the inner wall of the bucket 51 is substantially constant except for the bottom portion. Accordingly, the tapered shape of the tapered surface 55 of the bucket 51 is Ruined only on the outer peripheral surface side.

The lid 31 installed on the opening part 53 of the bucket 51 through threads covers the opening of the tube 60 and uses a sealing member 43 to keep the interior space of the bucket 51 in a sealed state, such that the interior space is not decompressed when the rotor chamber 8 is decompressed. A female thread is formed on the inner peripheral side of the opening part 53 of the bucket 51 while a male thread is formed on the outer peripheral surface of an installation part 34 of the lid 31. In this way, the male thread of the installation part 34 is screwed to the female thread of the opening part 53 to install the lid 31 to the bucket 51, so as to properly seal the interior space of the bucket 51 with the sealing member 43, such as an O-ring. By attaching the lid 31 to the bucket 51, the sample container 30 can swing with the rotation shaft 40 as the fulcrum. Moreover, the relationship between the installation part 34 of the lid 31 and the inner peripheral surface of the opening part 53 may be reversed to form a thread portion on the inner surface of the installation part 34 of the lid 31 and a thread portion on the outer peripheral side of the opening part 53.

The rotation shaft 40 is a member to be supported by the rotation shaft engaging grooves 22 formed on the rotor body 20. The member divided into two portions is pivotally supported by a pivot shaft 38 in the longitudinal center, so as to be bent a small angle. In addition, because the pivot shaft 38 is press-fitted from a hole 32*a* of the cylindrical part 32, the rotation shaft 40 does not fall off from the through hole 35. A plurality of disc springs 42 are disposed above the pivot shaft 38 through a spacer 41. The disc springs 42 are fixed in a compressed state by a set screw 39, which extends in the radial direction on the upper side of the disc springs 42. The set screw 39 passes through a screw hole 37 (see FIG. 4) formed in the cylindrical part 32 and is tightened from the outside of the cylindrical part 32. The disc springs 42 fixed by the set screw 39 apply a downward force on the central portion of the rotation shaft 40. Therefore, the rotation shaft 40 serves to support the load of the sample container 30 before the sample container 30 enters the swing state.

Figure 6:
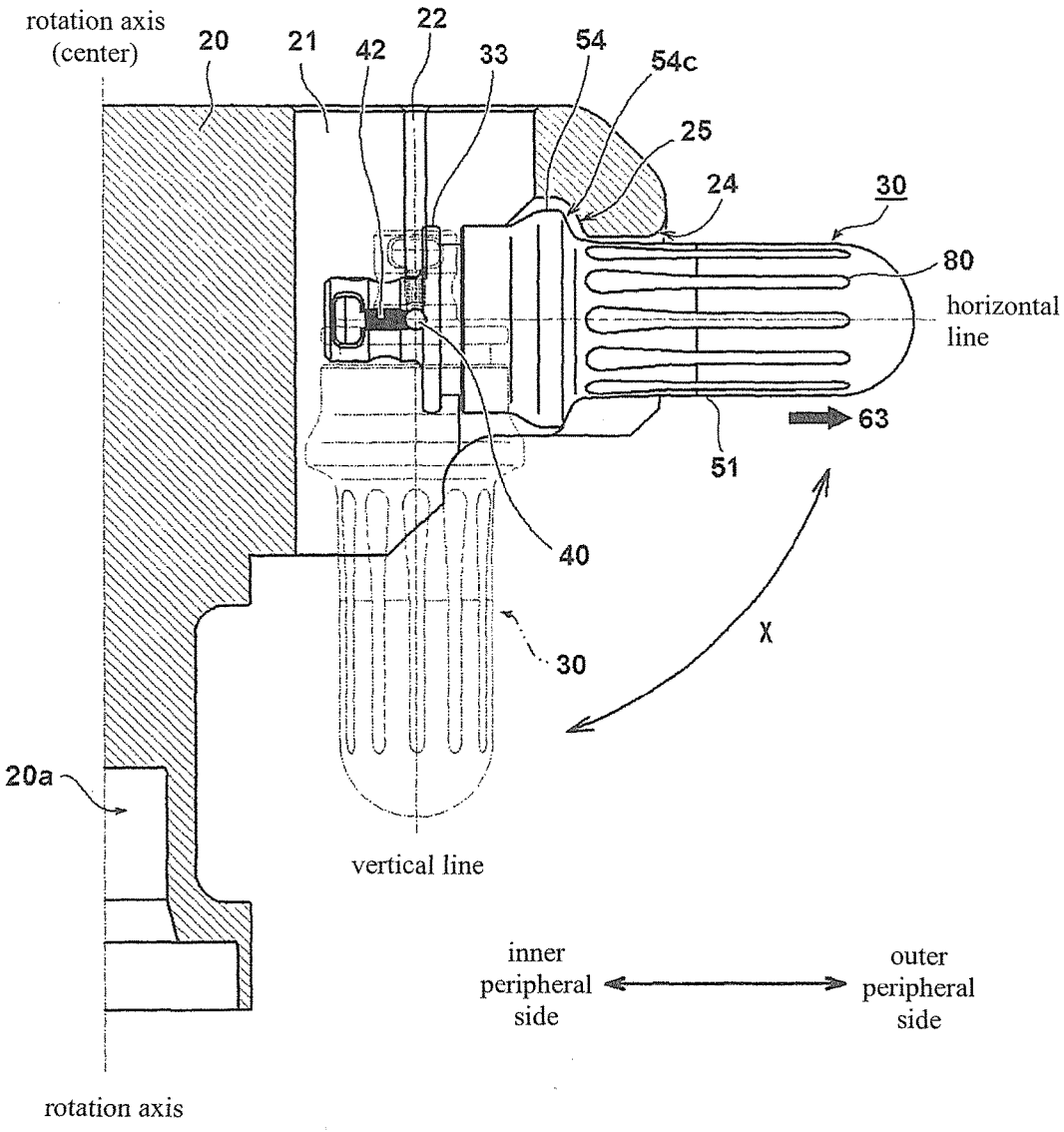
FIG. 6 is a view showing the sample container 30 in the swing state with respect to the rotor body 20 of FIG. 1.

FIG. 6 is a longitudinal cross-sectional view of a portion of the rotor body 20 of FIG. 1 in the axial direction, wherein the sample container 30 in dotted lines indicates the state when the rotor body 20 is stopped and the sample container 30 in solid lines indicates the state when the rotor body 20 is rotated at a low speed. Because of rotation of the rotor body 20, the sample container 30 is swung with the rotation shaft 40 as the center, as shown by a swing range X, from the position when the rotor body 20 is stopped, as indicated by the dotted lines, to the state when the rotor body 20 is rotated, as indicated by the solid lines. Since the rotation shaft 40 is supported by the lower ends of the rotation shaft engaging grooves 22, when a certain rotation speed is reached, the entire sample container 30 is swung with the rotation shaft 40 as the swing center and the longitudinal direction of the sample container 30 becomes horizontal, which is called a horizontal state. FIG. 6 illustrates a state of low-speed rotation (about 100-1,500 rpm, for example) right after the sample container 30 is swung to the horizontal direction. At the low-speed rotation speed right after such horizontal state, the centrifugal load applied on the sample container 30 is small. Thus, the force applied by the disc springs 42 keeps the two rotation shafts 40 in contact with the disc part 33. In other words, the disc springs 42 are hardly bent by the centrifugal load that is applied in the state of low-speed rotation right after the sample container 30 is swung to the horizontal direction. If the sample container 30 is swung in a state where the two rotation shafts 40 are maintained a straight line, the seating surface 54*c* of the flange part 54 and the bucket receiving surface 25 of the bucket accommodating part 24 are in a positional relationship of not in contact with each other. Thereby, the sample container 30 does not contact any part of the rotor body 20 when being swung in the swing range X and thus can be swung smoothly.

When the sample container 30 is swung to a completely horizontal state, if the rotation speed of the rotor body 20 is further increased to rotate the rotor body 20 at a high speed, the centrifugal load of the bucket 51, the lid 31, the tube 60, and the sample 61 filled in the tube 60 is added to the rotation shaft 40 that supports the centrifugal load of the sample container 30. The disc springs 42 that support the rotation shaft 40 are bent and the two rotation shafts 40 are bent at the connection part near the center. Consequently, the entire sample container 30, except for the rotation shaft 40, moves further in the direction of the arrow 63 (the outer peripheral side) from the position as shown, and the bucket receiving surface 25 and the seating surface 54*c* of the bucket 51 gradually approach each other and finally reach a state of favorable surface contact. This surface contact state is called "seating" in this embodiment. The rotation speed at the time of the seating is about 500-2,000 rpm, for example, and the range of surface contact is the contact portion between the bucket receiving surface 25 and the seating surface 54*c* of the sample container 30. For this reason, while the upper side of the seating surface 54*c* can be in full contact, the lower side can only be in partial contact because the bucket receiving surface 25 is formed with the opening for avoiding the bucket body (the tapered surface 55 or the parallel surface 56 of the bucket 51). Therefore, the seating surface of the bucket 51 has a portion that is supported by the inverted U-shaped range and a portion that is not supported, and the support state of the bucket 51 becomes non-uniform. As a result, a bending stress is applied on the bucket 51 in the longitudinal direction with the front end of the inverted U-shaped opening as the fulcrum. Thus, it is preferable to increase the thickness of the bucket 51 to cope with the bending stress, but it will result in increase of the weight. Therefore, in this embodiment, while the thickness of the tapered surface 55 or the parallel surface 56 under the flange part 54 (on the bottom side) of the bucket 51 is reduced on the radial outer side, a plurality of grooves 80 extending in the longitudinal direction are formed on the outer peripheral surface, so as to suppress increase of the overall weight as well as improve the rigidity of the bucket 51.

Figure 7:
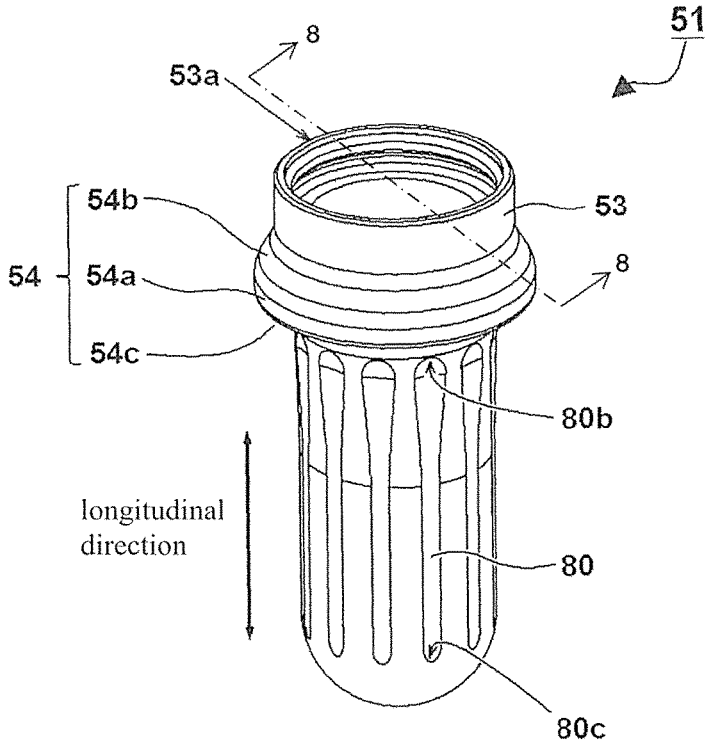
FIG. 7 is a perspective view showing the external appearance of the bucket 51 of the sample container 30 of FIG. 4.

FIG. 7 is a perspective view showing the external appearance of the bucket 51 of FIG. 4. The upper end of the opening part 53 is a circular opening 53*a*. The interval or groove length of the groove 80 of the bucket 51, the tapered shape of an upper end 80*b* and a lower end 80*c* of the groove 80, or the cross-sectional shape of the cross section perpendicular to the axial direction (particularly, radius of the curved surface) may be set as appropriate according to requirements of the bucket 51 (e.g. maximum rotation speed, the size or shape of the tube 60 to be accommodated, and so on) or the assumed stress state. Here, a plurality of grooves 80 are disposed at equal intervals in the circumferential direction, such that the bucket 51 is easy to grip and does not easily slip when the lid 31 is attached or removed (closed or opened). Therefore, the turning can also be facilitated.

Figure 8:
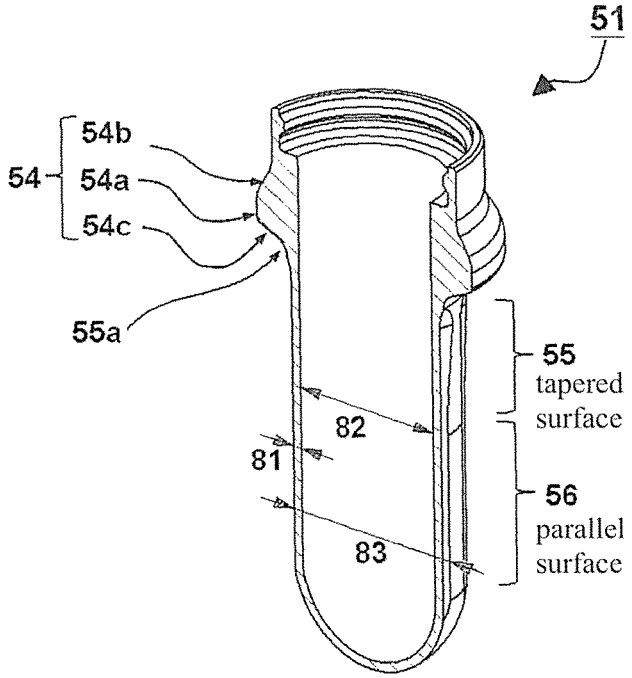
FIG. 8 is a longitudinal cross-sectional perspective view of the bucket 51 of the sample container 30 taken by the broken line 8-8 of FIG. 7.

FIG. 8 is a longitudinal cross-sectional perspective view of the bucket 51 taken by the broken line 8-8 of FIG. 7. Usually, it is necessary to increase a thickness 81 of the hollow cylindrical part of the bucket 51 in order to enhance the flexural rigidity of the bucket 51 with respect to the longitudinal direction. In such a case, since an inner diameter 82 is determined by the tube 60 that is to be used, the size thereof is difficult to change. What is changeable is an outer diameter 83. Increase of the outer diameter 83 will increase the thickness. The increase of the outer diameter 83 will result in increase of the weight of the sample container 30. However, by adjusting the shape (the radius of the curved surface of the cross-sectional shape) of the groove 80 or the depth of the deepest part of the groove 80 to adjust the weight of the bucket 51 to the same level before the change, it is possible to improve the rigidity of the sample container 30 against bending without changing the load applied to the rotor body 20. The depth of the groove 80 is set smaller than the thickness 81 near the parallel surface 56. Additionally, in this embodiment, a stress relaxing surface 55*a* is formed near the connection part of the seating surface 54*c* of the flange part 54 and the tapered surface 55. The stress relaxing surface 55*a* has a small curvature radius in the cross-sectional view as shown in FIG. 8, so as to avoid partial concentration of the bending stress. The stress relaxing surface 55*a* is described later with reference to FIG. 10(1) and FIG. 10(2).

Figure 9:
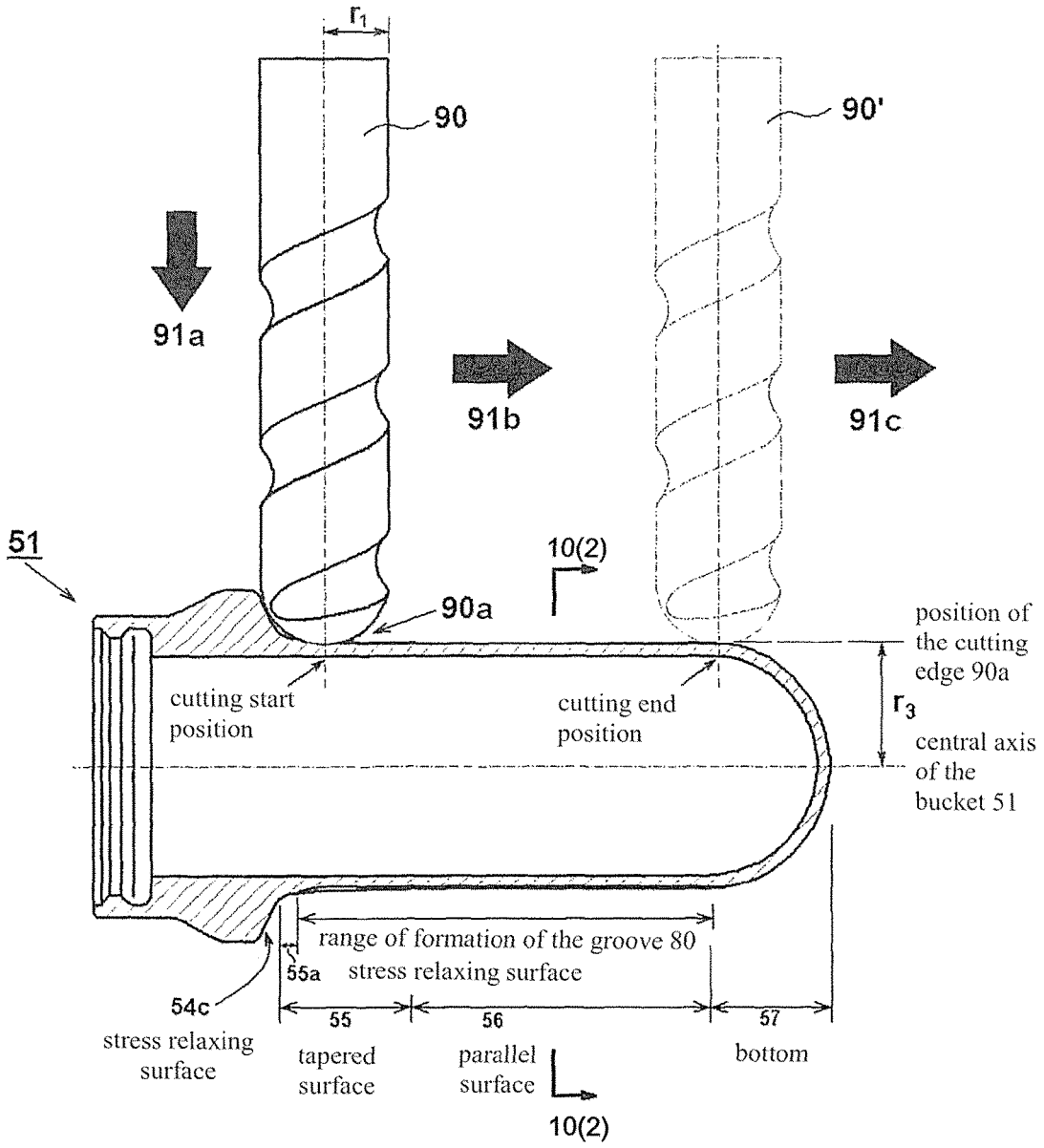
FIG. 9 is a view for illustrating the method of processing the groove 80 of the bucket 51.

FIG. 9 is a view for illustrating a method of processing the groove 80 of the bucket 51. First of all, a bucket 51 without the grooves 80 is formed by a processing method equivalent to the conventional method, and a milling machine (not shown) is used on the bucket 51 in this state to form the grooves 80. First, the bucket 51 is fixed by a fixing tool (not shown) so as not to rotate, and a ball end mill 90 approaches the bucket 51 in the direction of the arrow 91*a*. The ball end mill 90 has a hemispherical front end with a radius $r_1$ and is used to cut the groove 80 having a curved surface here. The ball end mill 90 is moved in the direction of the arrow 91*a*, and when the ball end mill 90 cuts the bucket 51 to an extent that the distance from the central axis of the bucket 51 to the front end 90*a* of the ball end mill 90 reaches a predetermined distance $r_3$, the ball end mill 90 is moved in the direction of the arrow 91*b* with the distance $r_3$ maintained. When the ball end mill 90 is moved from the position of the ball end mill 90', as indicated by the dotted lines, further toward the bottom as shown by the arrow 91*c*, an end shape of the groove 80 on the bottom side (the lower end 80*c* of FIG. 7) is formed. Thus, the groove 80 is formed by moving the ball end mill 90 in the direction from the arrow 91*b* to 91*c* without changing the distance $r_3$ between the front end 90*a* of the ball end mill 90 and the central axis of the bucket 51. The groove 80 is preferably formed to be continuous for ½ or more of the length of the tapered surface 55 and ½ or more of the length of the parallel surface 56 respectively from the boundary portion between the tapered surface 55 and the parallel surface 56. Here, based on the boundary between the tapered surface 55 and the parallel surface 56, the groove 80 has a length of about 85% on the side of the tapered surface 55 and is formed over the entire area on the side of the parallel surface 56. As a result, the opening of the groove 80 near the tapered part is wide and the opening of the groove 80 on the parallel surface is narrower than the tapered part. Moreover, because the bottom 57 is narrowed down into a hemispherical shape, the opening shape of the end of the groove 80 is substantially semicircular. Thus, the opening surface 80*a* whose contour shape is a combination of curved lines and straight lines is formed on the groove 80. The upper end 80*b* (see FIG. 7) and the lower end 80*c* respectively have a tapered shape with the front end narrowed down into a hemispherical shape. The cutting process of the groove 80 is repeated multiple times at equal intervals in the circumferential direction, so as to form a plurality of the grooves 80 (twelve here).

On the bucket 51, the stress relaxing surface 55*a*, which has a small curvature radius, is formed right under the seating surface 54*c* (the side of the bottom 57). The bucket 51 has a constant inner diameter, except for the bottom portion. Regarding the outer diameter, although the outer diameter is constant in the parallel surface 56, in the tapered surface 55, a tapered shape is formed such that the outer diameter slightly decreases from the upper side (the side of the opening part 53) to the lower side (the side of the bottom 57). The stress relaxing surface 55*a* is also a part of the tapered surface 55. Here, it is important to set the position for performing the cutting process using the ball end mill 90 (particularly, a start point as viewed in the axial direction of the bucket central axis). Next, the positional relationship between a cutting start point and a cutting end point is explained with reference to FIG. 10(1) and FIG. 10(2).

Figure 10:
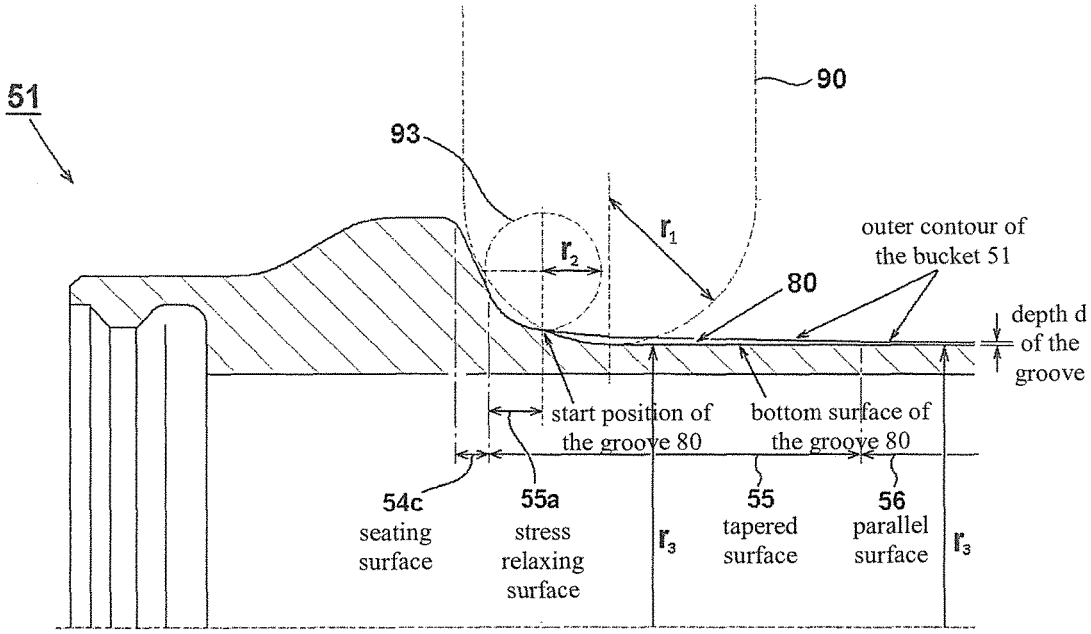
FIG. 10(1) is a view for illustrating the positional relationship between the stress relaxing surface 55*a* and the groove 80 of the bucket 51.
Figure 10:
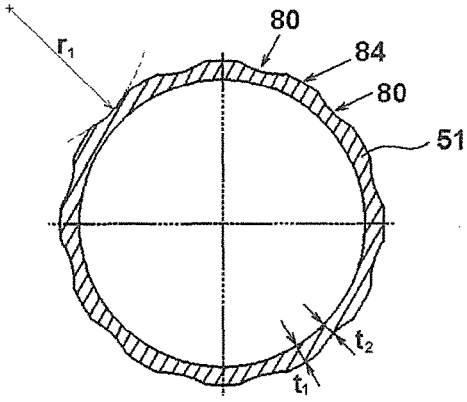

FIG. 10(1) is a view for illustrating the positional relationship between the stress relaxing surface 55*a* and the groove 80 of the bucket 51. Curved surface processing of the stress relaxing surface 55*a* is performed using an end mill 93 as a process before the processing of the groove 80. Here, the end mill 93 with a radius r2 is positioned to place the longitudinal direction thereof in a direction perpendicular to the central axis of the bucket 51 and the bucket 51 is cut while being rotated around the central axis, so as to form the stress relaxing surface 55*a*. Because the stress relaxing surface 55*a*, which is a curved surface, does not contact the rotor body 20, it is preferably formed such that the boundary surface between the seating surface 54*c* and the stress relaxing surface 55*a* is a continuous surface. Processing of the seating surface 54*c* and processing of the stress relaxing surface 55*a* may overlap near the boundary surface between the seating surface 54*c* and the stress relaxing surface 55*a*. Then, formation of the grooves 80 is carried out by using the ball end mill 90. This formation is to make the axis of the ball end mill 90 approach in the radial direction of the bucket 51. The position of the ball end mill 90 shown in FIG. 10(1) indicates the cutting start position. Since the front end position of the ball end mill 90 in this cutting start position is slightly away from the seating surface 54*c*, the processing of the seating surface 54*c* is not performed. In other words, the groove 80 is not formed on the seating surface 54*c* and remains within the range of the tapered surface 55. Furthermore, here, the groove 80 is formed to avoid the stress relaxing surface 55*a*. It can be understood from FIG. 10(1) that, with respect to the outer contour of the bucket 51, the depth of the bottom surface of the groove 80 from the surface of the tapered surface 55 changes whereas the depth from the surface of the groove 80 in the parallel surface 56 is a constant value d. The cross-sectional shape of the groove 80 (the cross section taken by broken line 10(2)-10(2) of FIG. 9) formed by the above is shown in FIG. 10(2). Here, the thickness of the deepest part of the groove 80 and the inner wall is t2 and the thickness of a portion 84 where the groove 80 is not formed is t1, wherein t1>t2. Given that the thickness of the conventional bucket is t, if the relationship is set to tl>t>t2 and the weight of the bucket 51 is made substantially equal to that of the conventional bucket, the flexural rigidity of the bucket 51 can be increased significantly.

According to this embodiment, as described above, the bucket 51 of the sample container 30 is integrally formed with the grooves 80 disposed for a predetermined length in the longitudinal direction of the cylindrical surface. Therefore, partial deformation of the sample container 30 due to non-uniform support of the bucket receiving surface 25 can be suppressed, and consequently, it is possible to reduce the stress caused by bending of the bucket 51. In addition, since disposing the grooves 80 on the outer peripheral surface of the bucket 51 allows the operator to grip the bucket 51 easily and prevents the bucket 51 from slipping, the effect of facilitating the opening and closing of the lid 31 can be achieved as well. Further, the load applied on the rotor body 20 or the sample container 30 can also be reduced. Thus, the lifespan of the rotor body 20 and the sample container 30 can be prolonged to reduce the running cost.

Embodiment 2

Figure 11:
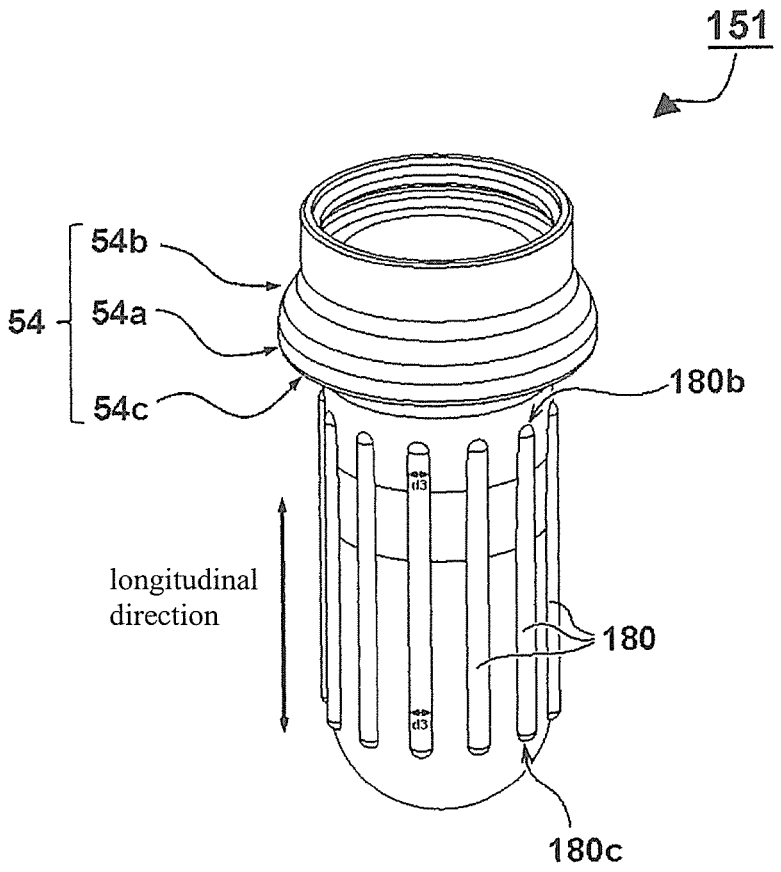
FIG. 11 is a perspective view of the bucket 151 according to the second embodiment of the invention.

Next, the second embodiment of the invention is described with reference to FIG. 11. In FIG. 11, in contrast to the first embodiment, a plurality of ribs 180 having a convex shape are disposed on the cylindrical surface of a bucket 151. It is expected that it will be difficult to process such a shape by machine. Therefore, it is preferable to form the shape integrally by casting or forging. In this case, as compared with the bucket 51 of the first embodiment, instead of slightly reducing the outer diameter to thin the thickness (equivalent to 81 of FIG. 8), the ribs 180 are disposed to reduce the weight of the sample container 30 and improve the rigidity against bending. The ribs 180 are arranged at equal intervals in the circumferential direction of the bucket 151 and are disposed not to interfere with the adjacent ribs 180. Here, twelve ribs 180 are formed. The shape of the front end of the convex rib 180 (an upper end 180*b* and a lower end 180*c*) is a continuous curved surface when viewed in a cross section perpendicular to the rib 180. However, a continuous rectangular or polygonal shape also achieves the same effect. A vertical cross-sectional shape of the rib 180 may be a continuous curved or polygonal cross section. By forming the ribs 180 in this way, it is possible to reduce the stress caused by bending of the bucket 151. In addition, with the ribs 180, the bucket 151 is easy to grip and does not easily slip. Therefore, the effect of facilitating the opening and closing of the lid 31 can be achieved as well.

Although the invention has been described above based on the embodiments, the invention should not be construed as limited to the aforementioned embodiments, and various modifications may be made without departing from the spirit of the invention. For example, the number of the grooves 80 or the ribs 180 that are formed can be set at will as long as it is plural. Moreover, how long the grooves 80 or the ribs 180 are to be formed in the axial direction of the bucket is determined relatively freely if they do not interfere with the seating surface 54*c*. Further, the ball end mill 90 is used to form the grooves 80 in the above embodiment. However, the cutting method is not limited thereto, and other cutting tools may also be used to carry out the processing, or the processing method of the bucket 51 may be changed to form the grooves or ribs. The cross-sectional shape perpendicular to the longitudinal direction of the grooves may be V-shaped or U-shaped. In addition, the grooves 80 may be formed starting from a position away from the stress relaxing surface 55*a*, such as the substantially central part of the tapered surface 55, for example.

What is claimed is:

1. A centrifuge, comprising:

a driving part comprising a driving shaft;

a rotor body disposed on a front end of the driving shaft; and a sample container comprising a rotation shaft for swing, wherein the rotor body comprises a through hole, a pair of support parts rotatably supporting two ends of the rotation shaft of the sample container installed in the through hole, and a cutout part formed on a radial outer side in a vertical direction with respect to a central axis of the through hole, the centrifuge swings the sample container in a state where the rotation shaft is supported by the support parts by rotation of the rotor body and performs a centrifugation in a state where the sample container is seated on a bucket receiving surface of the rotor body, the sample container comprises a bucket accommodating a container to be filled with a sample, and a lid for sealing the bucket and comprising the rotation shaft, and the bucket comprises a seating surface to be seated on the rotor body during a centrifugal rotation, and a plurality of spaced-apart grooves extending in a longitudinal direction on an outer peripheral surface on a bottom side with respect to the seating surface of the bucket, wherein a thickness of portions of the bucket between the spaced-apart grooves is larger than a thickness of portions of the bucket where a deepest part of the spaced-apart grooves is formed.

2. The centrifuge according to claim 1, wherein an opening surface of the spaced-apart grooves comprises a tapered end part near the seating surface and a tapered end part near a bottom.

3. The centrifuge according to claim 2, wherein a cross-sectional shape of the spaced-apart grooves perpendicular to the longitudinal direction of the spaced-apart grooves has a curved surface or a V shape.

4. The centrifuge according to claim 3, wherein the bucket comprises an opening part, the seating surface formed on a lower side with respect to the opening part, a parallel surface having a substantially constant outer diameter, and the bottom closing a front end of the parallel surface, the seating surface and an outer surface of the parallel surface are connected by a tapered surface having an outer diameter that gradually decreases from the seating surface to the parallel surface, and the spaced-apart grooves are formed to extend from a part of the tapered surface throughout the outer surface of the parallel surface.

5. The centrifuge according to claim 4, wherein the spaced-apart grooves are formed to be continuous for ½or more of a length of the tapered surface and ½or more of a length of the parallel surface respectively from a boundary portion between the tapered surface and the parallel surface.

6. The centrifuge according to claim 5, wherein a width of the spaced-apart grooves in a side view of the bucket is wide in a part near the seating surface and narrow in a part near the bottom.

7. The centrifuge according to claim 1, wherein the bucket is integrally formed with a titanium alloy or an aluminum alloy.

8. The centrifuge according to claim 1, wherein four or more of the spaced-apart grooves are formed at equal intervals in a circumferential direction of the bucket without interfering with one another.

9. A swing rotor for a centrifuge, comprising:

a sample container comprising a rotation shaft; and a rotor body comprising a through hole, a pair of support parts rotatably supporting two ends of the rotation shaft of the sample container installed in the through hole, and a cutout part formed on a radial outer side in a vertical direction with respect to a central axis of the through hole, wherein the sample container comprises a bucket accommodating a container to be filled with a sample, and a lid for sealing the bucket and comprising the rotation shaft, and the bucket comprises a seating surface to be seated on the rotor body during a centrifugal rotation, and a plurality of spaced-apart grooves extending in a longitudinal direction on an outer peripheral surface on a bottom side with respect to the seating surface of the bucket, wherein a thickness of portions of the bucket between the spaced-apart grooves is larger than a thickness of portions of the bucket where a deepest part of the spaced-apart grooves is fonned.

10. The swing rotor for the centrifuge according to claim 9, wherein an opening surface of the spaced-apart grooves comprises a tapered end part near the seating surface and a tapered end part near a bottom, and a cross-sectional shape of the spaced-apart grooves perpendicular to the longitudinal direction of the spaced-apart grooves has a curved surface or a V shape.

11. The swing rotor for the centrifuge according to claim 10, wherein the bucket comprises an opening part, the seating surface formed on a lower side with respect to the opening part, a parallel surface having a substantially constant outer diameter, and the bottom closing a front end of the parallel surface, the seating surface and an outer surface of the parallel surface are connected by a tapered surface having an outer diameter that gradually decreases from the seating surface to the parallel surface, and the spaced-apart grooves are formed to extend from a part of the tapered surface throughout the outer surface of the parallel surface.

12. The swing rotor for the centrifuge according to claim 11, wherein the spaced-apart grooves are formed to be continuous for ½or more of a length of the tapered surface and ½ or more of a length of the parallel surface respectively from a boundary portion between the tapered surface and the parallel surface.

13. The swing rotor for the centrifuge according to claim 9, wherein four or more of the spaced-apart grooves are formed at equal intervals in a circumferential direction of the bucket without interfering with one another.

* * * * *